US011549474B2

(12) United States Patent
Martin et al.

(10) Patent No.: US 11,549,474 B2
(45) Date of Patent: Jan. 10, 2023

(54) DUCTED FUEL INJECTOR HAVING NESTED CHECKS WITH NON-ROTATING OUTER CHECK AND METHOD OF OPERATING SAME

(71) Applicant: Caterpillar Inc., Peoria, IL (US)

(72) Inventors: Glen Clifford Martin, Peoria, IL (US); Bobby John, Peoria, IL (US); Jonathan William Anders, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 29 days.

(21) Appl. No.: 17/328,172

(22) Filed: May 24, 2021

(65) Prior Publication Data

US 2022/0372942 A1 Nov. 24, 2022

(51) Int. Cl.

| | |
|---|---|
| ***F02M 61/10*** | (2006.01) |
| ***F02M 61/18*** | (2006.01) |
| ***F02M 61/04*** | (2006.01) |

(52) U.S. Cl.

CPC ..... *F02M 61/1813* (2013.01); *F02M 61/045* (2013.01); *F02M 61/1826* (2013.01)

(58) Field of Classification Search

CPC ..... F02M 61/1813; F02M 61/1826; F02M 61/1866; F02M 61/045; F02M 2200/46

See application file for complete search history.

(56) References Cited

U.S. PATENT DOCUMENTS

| | | | |
|---|---|---|---|
| 5,072,706 | A | 12/1991 | Eblen et al. |
| 6,422,199 | B1 | 7/2002 | Buckley et al. |
| 7,556,017 | B2 | 7/2009 | Gibson |
| 9,453,483 | B2 | 9/2016 | Kim |
| 9,957,939 | B2 | 5/2018 | Mahato et al. |
| 9,964,088 | B2 | 5/2018 | Zhang |
| 10,012,196 | B1 | 7/2018 | Qi et al. |
| 10,151,235 | B2 | 12/2018 | Anders et al. |
| 10,161,626 | B2 | 12/2018 | Mueller |

(Continued)

FOREIGN PATENT DOCUMENTS

| | | | |
|---|---|---|---|
| DE | 10319980 | A1 | 8/2014 |
| GB | 2003550 | B | 10/1982 |

(Continued)

*Primary Examiner* — Grant Moubry
*Assistant Examiner* — James G Moubry
(74) *Attorney, Agent, or Firm* — Brannon Sowers & Cracraft

(57) ABSTRACT

A fuel injector includes an injector housing having a nozzle assembly with a nozzle piece, and a nested check assembly of an outer check and an inner check. Spray orifices are formed in the nozzle piece in a first orifice set equipped with a first spray duct set and a second orifice set equipped with a second spray duct set. The inner check can be opened to spray fuel from the first orifice set and the outer check can be opened to spray fuel from both the first orifice set and the second orifice set. The outer check is non-rotating while the inner check can be permitted to rotate during service. Spray ducts associated with the first orifice set may have a different duct length and duct inside diameter than spray ducts associated with the second orifice set. The first orifice set may include lower-flow spray orifices and the second orifice set may include higher-flow spray orifices. Related methodology is also disclosed.

19 Claims, 4 Drawing Sheets

(56) References Cited

U.S. PATENT DOCUMENTS

| | | | | |
|---|---|---|---|---|
| 10,563,597 | B2 | 2/2020 | John et al. | |
| 10,570,865 | B2 | 2/2020 | Zhang | |
| 10,900,450 | B1 * | 1/2021 | John | F02M 61/10 |
| 11,035,333 | B1 * | 6/2021 | Wiebrecht | F02F 3/28 |
| 11,236,719 | B2 * | 2/2022 | Kawakami | F02P 19/02 |
| 2019/0145340 | A1 * | 5/2019 | John | F02D 41/40 123/299 |
| 2019/0170103 | A1 * | 6/2019 | Martin | F02M 61/1806 |
| 2019/0195183 | A1 | 6/2019 | Hashizume | |
| 2020/0003167 | A1 | 1/2020 | Tavernier | |

FOREIGN PATENT DOCUMENTS

| | | | |
|---|---|---|---|
| GB | 2348247 | B | 2/2003 |
| WO | 03078824 | A1 | 9/2003 |

* cited by examiner

DUCTED FUEL INJECTOR HAVING NESTED CHECKS WITH NON-ROTATING OUTER CHECK AND METHOD OF OPERATING SAME

TECHNICAL FIELD

The present disclosure relates generally to ducted fuel injection, and more particularly to a nested-check ducted fuel injector with a non-rotating outer check.

BACKGROUND

Modern internal combustion engines include one or more cylinders each with an associated piston to define a combustion chamber. Fuel for combustion is delivered into the combustion chamber by, for example, directly injecting the fuel using a fuel injector. Such fuel injectors have at least one and typically several spray orifices, the opening and closing of which is controlled by way of an electrically or hydraulically actuated outlet check.

Varying fuel and air mixtures, different fuel delivery parameters, equivalence ratios and other factors can produce a range of results during combustion. Certain constituents in exhaust from an internal combustion engine are often filtered, chemically reduced, or otherwise treated to limit discharge of those constituents to the environment. In recent years there has been great interest in controlling and/or managing the manner and mechanisms of combustion in an effort to control the exhaust emissions profile of internal combustion engines. Notable amongst the emissions it is generally desirable to limit are particulate matter and oxides of nitrogen or "NOx."

Ducted fuel injection assemblies have been implemented in internal combustion engines to enhance mixing and reduce the amount of particulate matter, namely, soot, formed within the combustion chamber. Ducted assemblies typically include one or more tubular structures coupled to the cylinder head in the engine and positioned such that the ducts receive fuel spray jets from the fuel injector. The fuel spray tends to interact with the ducts, to ultimately enhance mixing of the fuel with air, in particular by increasing the so called "liftoff length" of the fuel spray jets to enable air to mix with the plumes of fuel.

One known ducted fuel injection application is set forth in U.S. Pat. No. 10,012,196B1 and entitled Duct Structure for Fuel Injector Assembly. While known ducted fuel injection techniques show promise for widespread application, there is always room for improvement and alternative strategies.

SUMMARY OF THE INVENTION

In one aspect, a fuel injector includes an injector housing having a nozzle piece defining an injector axis, and including spray orifices formed therein arranged in a first orifice set and a second orifice set. An outer check is within the nozzle piece and movable between a closed position, where each of the first orifice set and the second orifice set are blocked, and an open position, and includes transfer passages formed therein. An inner check is within the outer check and movable relative to the outer check between a closed position, where the transfer passages are blocked, and an open position. Spray ducts are coupled to the nozzle piece and each arranged for ducting spray jets of fuel from one of the spray orifices. The outer check is supported at a fixed angular orientation about the injector axis, such that the transfer passages are each in circumferential alignment with one of the spray orifices of the first orifice set.

In another aspect, a method of operating a fuel injector includes moving an inner check nested with an outer check in a fuel injector from a closed position to an open position to fluidly connect a first fuel passage formed between the inner check and the outer check to transfer passages formed in the outer check and fluidly connected to lower-flow spray orifices formed in a nozzle piece of the fuel injector. The method further includes spraying fuel from the lower-flow spray orifices based on the moving of the inner check from a closed position to an open position. The method further includes moving the outer check from a closed position to an open position to fluidly connect a second fuel passage formed between the outer check and the nozzle piece to both the lower-flow spray orifices and higher-flow spray orifices formed in the nozzle piece. The method still further includes spraying fuel from both the lower-flow spray orifices and the higher-flow spray orifices based on the moving of the outer check from a closed position to an open position, and ducting all of the fuel sprayed from the lower-flow spray orifices and from the higher-flow spray orifices through spray ducts coupled to the nozzle piece.

In still another aspect, a fuel injector nozzle assembly includes a nozzle piece defining an injector axis and having an outer nozzle surface, an inner nozzle surface forming a nozzle seat, and having spray orifices formed therein extending from the inner nozzle surface to the outer nozzle surface. The spray orifices include lower-flow spray orifices forming a first orifice set, and higher-flow spray orifices forming a second orifice set, each orifice set having a circumferential distribution about the injector axis. The assembly further includes spray ducts coupled to the nozzle piece and arranged for ducting spray jets of fuel from the first orifice set and the second orifice set, and an outer check within the nozzle piece and movable between a closed position in contact with the nozzle seat, where the second orifice set is blocked, and an open position, and the outer check has an outer check surface, an inner check surface forming a check seat, and having transfer passages formed therein extending from the inner check surface to the outer check surface. The assembly further includes an inner check within the outer check and movable relative to the outer check between a closed position in contact with the check seat, where the transfer passages are blocked, and an open position.

DETAILED DESCRIPTION

Figure 1:
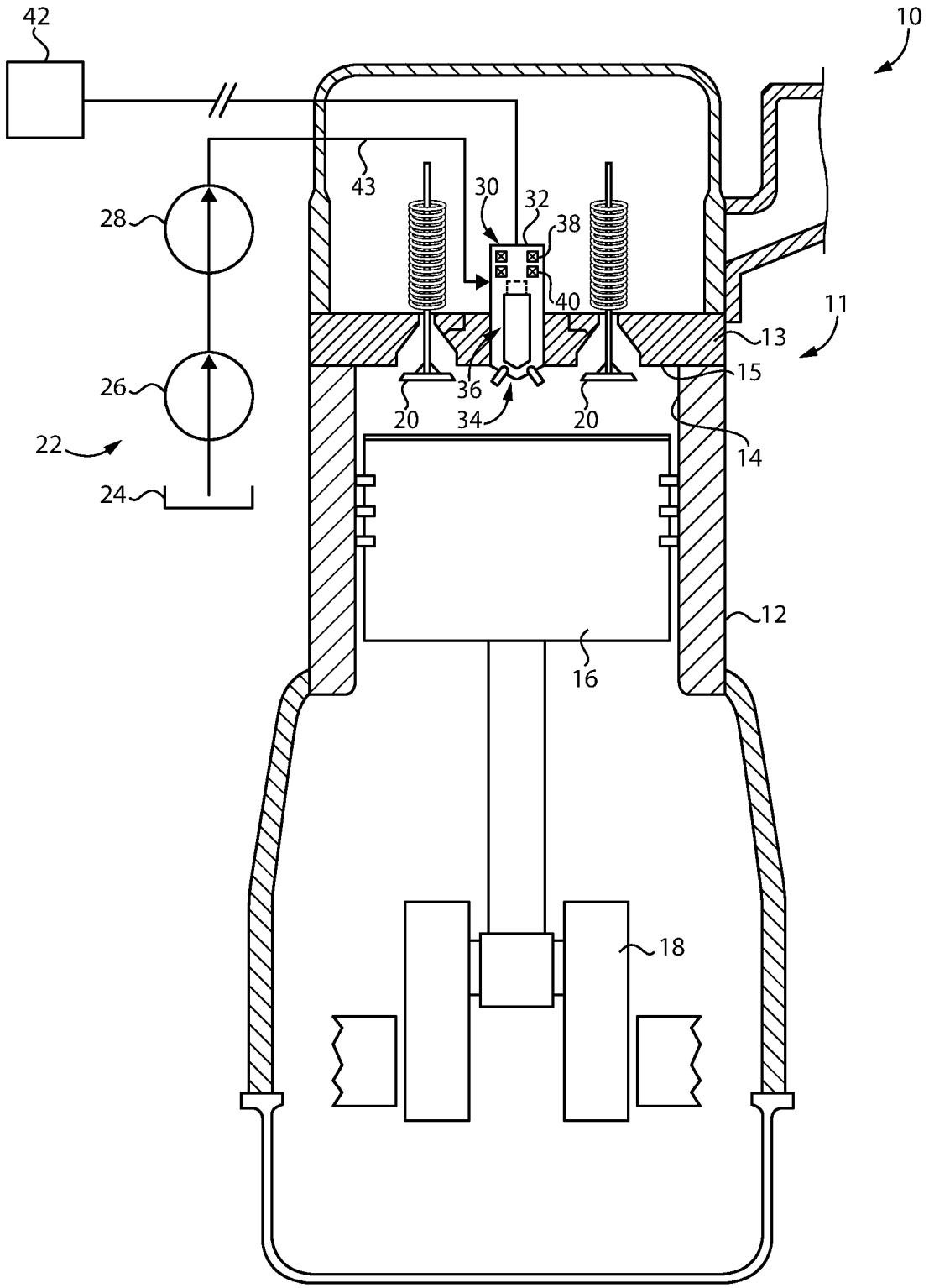
FIG. 1 is a sectioned diagrammatic view of an internal combustion engine system, according to one embodiment.

Referring to FIG. 1, there is shown an internal combustion engine system 10 according to one embodiment, and including an internal combustion engine 11 having a cylinder block or engine housing 12. A combustion cylinder 14 is formed in engine housing 12 and may be one of a plurality of combustion cylinders in any suitable arrangement such as an inline pattern, a V-pattern, or still another. A piston 16 is movable in combustion cylinder 14 between a bottom-dead-center position and a top-dead-center position to rotate a crankshaft 18 in a generally conventional manner. Engine 11 will typically be operated in a conventional four-stroke engine cycle, although the present disclosure is not limited in this regard. Engine valves 20 are supported in engine housing 12 to control fluid connections between combustion cylinder 14 and an intake system and exhaust system, again in a generally conventional manner. A cylinder head 13 having a cylinder head inside surface 15 is attached to engine housing 12. Engine 11 may be a compression-ignition engine such that piston 16, and other pistons associated with other combustion cylinders, increases a pressure in combustion cylinder 14 in a compression stroke to an auto-ignition threshold. Any suitable compression-ignition liquid fuel, such as a diesel distillate fuel, or potentially combinations of a directly injected liquid fuel and a fumigated, port-injected, or directly-injected gaseous fuel can be used within the context of the present disclosure.

Engine system 10 further includes a fuel system 22. Fuel system 22 includes a fuel tank 24, a low pressure transfer pump 26, and a high pressure pump 28. High pressure pump 28 could feed pressurized fuel at an injection pressure to a common rail in some embodiments. High pressure pump 28 could alternatively be one of a plurality of so-called unit pumps each associated with one, or more than one but less than all, of a plurality of fuel injectors each associated with one combustion cylinder in engine 11. At least one fuel conduit 43 extends to a fuel injector 30. Fuel injector 30 is positioned for direct injection of fuel into combustion cylinder 14, and includes an injector housing 32, a nozzle assembly 34, and a nested check assembly 36, as further described herein. Fuel injector 30 may include a first electrical actuator 38 operable to control opening and closing of a first check in check assembly 36, and a second electrical actuator 40 operable to control opening and closing of a second check in check assembly 36. Fuel system 22 also includes or is controlled by an electronic control unit 42 structured to selectively energize and deenergize electrical actuators 38 and 40. Those skilled in the art will appreciate that electrical actuators 38 and 40 can be associated with control valves (not shown) that are moved within fuel injector 30 to vary a closing hydraulic pressure on the checks in nested check assembly 36. As will be further apparent from the following description fuel injector 30 is ducted, to provide for certain improvements in performance respecting emissions and/or efficiency.

Figure 2:
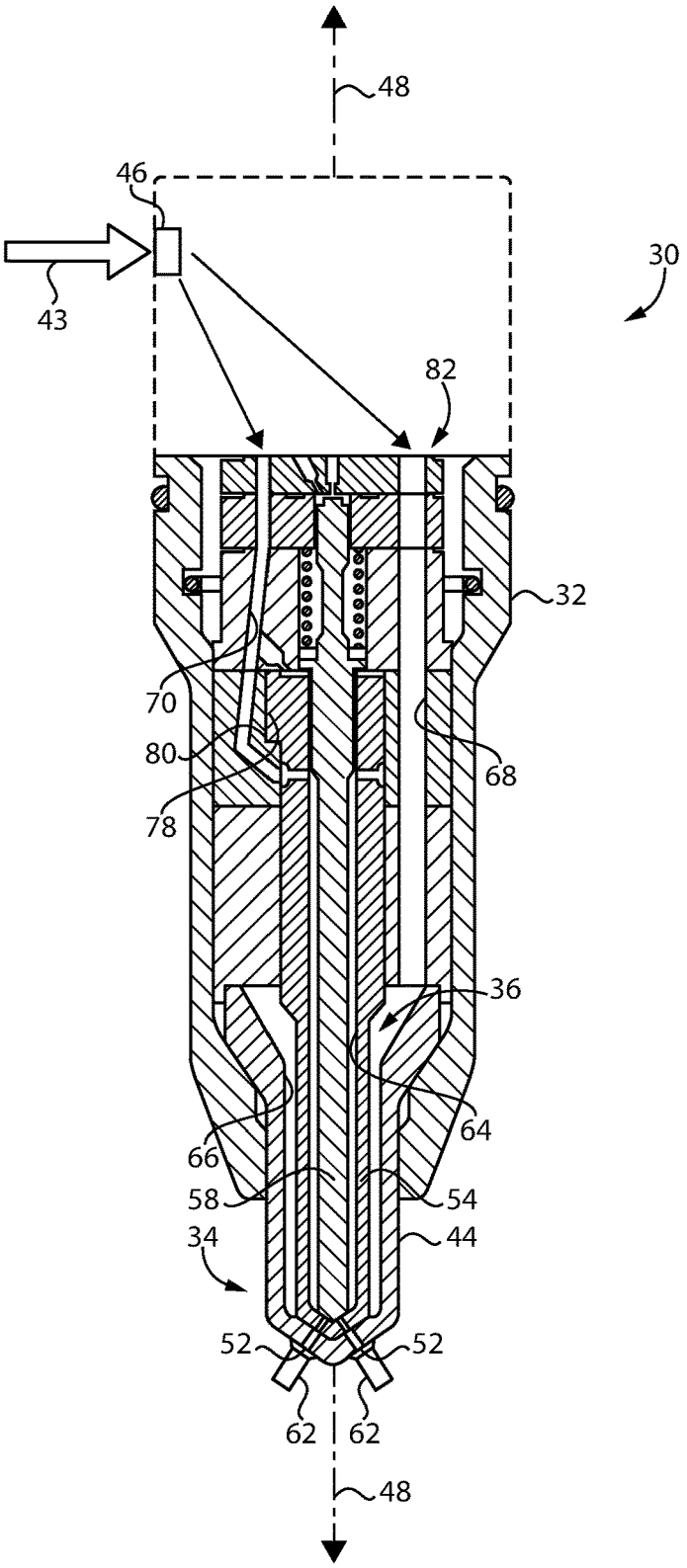
FIG. 2 is a sectioned side diagrammatic view of a fuel injector, according to one embodiment.

Referring also now to FIG. 2, there are shown features of fuel injector 30 in further detail. Injector housing 32 has at least one fuel inlet 46 formed therein that receives a feed of fuel, at an injection pressure or to be pressurized to an injection pressure in fuel injector 30, from one or more fuel supply conduits 43. In one embodiment, a first fuel supply conduit could supply fuel at a first pressure and a second fuel supply conduit could supply fuel at a second pressure. In other embodiments a single fuel supply conduit could supply fuel to fuel inlet 46. As suggested, fuel could be pressurized within or in close association with fuel injector 30, such as by way of a mechanically actuated fuel pressurization plunger coupled with an engine cam or a plunger that is hydraulically actuated. The present disclosure is not limited with regard to the relative location or manner of fuel pressurization.

Figure 3:
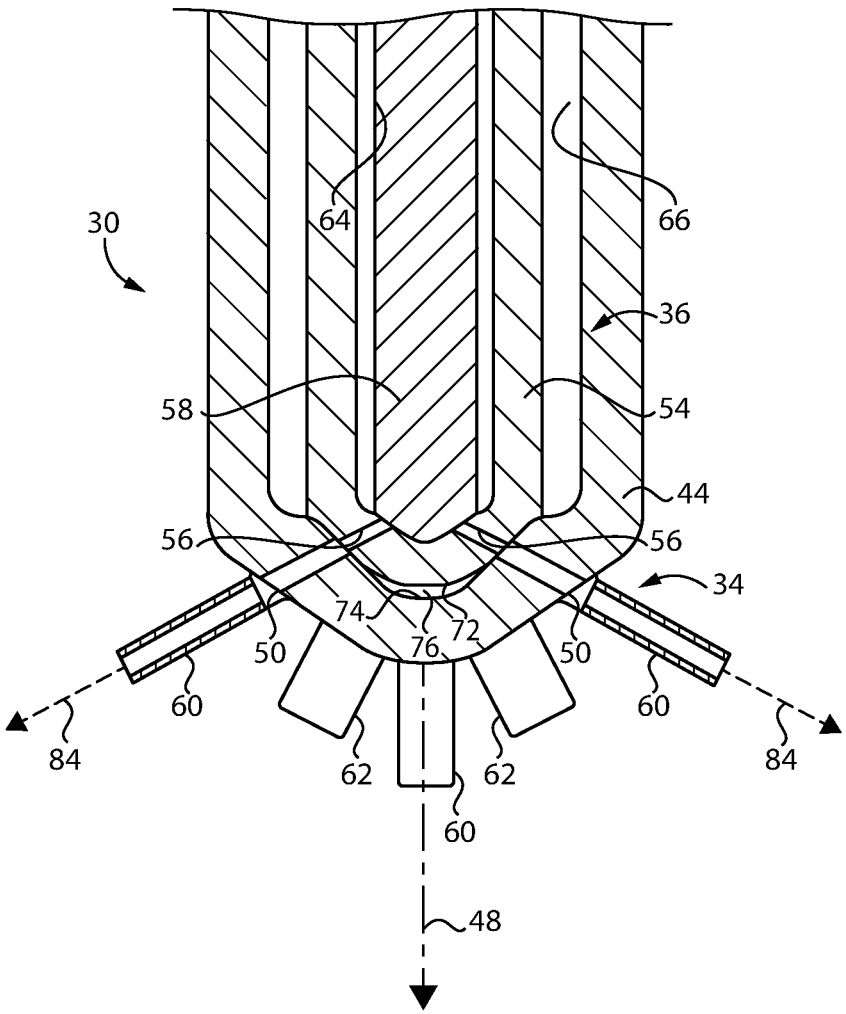
FIG. 3 is a sectioned side diagrammatic view of a portion of a fuel injector, according to one embodiment.

Injector housing 32 includes a nozzle piece 44 defining an injector axis 48. Nozzle piece 44 includes a plurality of spray orifices formed therein arranged in a first orifice set and a second orifice set. In the section plane of FIG. 2 spray orifices of a second orifice set 52 are visible. Referring also now to FIG. 3, nozzle piece 44 includes an outside or outer nozzle surface 94 and an inside or inner nozzle surface 96. Spray orifices in first orifice set 50 are visible in the section plane of FIG. 3 and of FIG. 4, further discussed herein. Spray orifices in second orifice set 52 are visible in the section plane of FIG. 5, also further discussed herein. Spray orifices of first orifice set 50 and spray orifices of second orifice set 52 extend from inner nozzle surface 96 to outer nozzle surface 94, and each respective orifice set has a circumferential distribution about injector axis 48. The circumferential distributions will typically be regular, but could be non-regular in some embodiments. Orifice sets 50 and 52 could be arranged at the same spray angle set-to-set, or at different spray angles, and could be the same or different in spray orifice number. Nozzle piece 44 further includes a nozzle seat 98 formed by inner nozzle surface 96.

Nested check assembly 36 includes an outer check 54 within nozzle piece 44 and movable between a closed position, in contact with nozzle seat 98, where first orifice set 50 is not blocked and second orifice set 52 is blocked, and an open position where each of first orifice set 50 and second orifice set 52 is not blocked. Outer check 54 further includes an outside or outer check surface 104 and an inside or inner check surface 106 forming a check seat 108. Transfer passages 56 are formed in outer check 54 and extend from inner check surface 106 to outer check surface 104. It can also be seen from the Figures that outer check 54 includes an outside tip surface 72 and nozzle piece 44 includes an inside sac surface 74. A sac 76 is formed between outside tip surface 72 and inside sac surface 74. Each of outside tip surface 72 and inside sac surface 74 may be continuous, meaning uninterrupted, such that whatever volume is formed by sac 76 is closed and unconnected to combustion cylinder 14 when outer check 54 is closed. Nested check assembly 36 further includes an inner check 58 within outer check 54 and coaxially arranged therewith. Inner check 58 is movable relative to outer check 54 between a closed position, in contact with check seat 108 such that transfer passages 56 are blocked, and an open position.

A first fuel passage 64 is formed between outer check 54 and inner check 58, and a second fuel passage 66 is formed between nozzle piece 44 and outer check 54. At the open position of outer check 54 all of the spray orifices of first orifice set 50 and second orifice set 52 are fluidly connected to second fuel passage 66. When inner check 58 is at an open position and outer check 54 is at a closed position, spray orifices of first orifice set 50 are fluidly connected to first fuel passage 64 by way of transfer passages 56. Thus, when inner check 58 is open and outer check 54 is closed fuel can be injected into combustion cylinder 14 through first orifice set 50 only. When outer check 54 is open fuel can be injected through both first orifice set 50 and second orifice set 52. In an implementation a total number of transfer passages 56, for example from four transfer passages to nine transfer passages, is equal to a total number of spray orifices in first orifice set 50. A circumferential distribution of transfer passages 56 about injector axis 48 may be matched to a circumferential distribution of spray orifices in first orifice set 50.

Outer check 54 may be supported at a fixed angular orientation about injector axis 48, such that transfer passages 56 are each in circumferential alignment with one of the spray orifices of first orifice set 50. In the illustrated embodiment, injector housing 32 includes a stack 82. A stack piece (not numbered) in stack 82 includes a fixed anti-rotation surface 80. Outer check 54 includes a guide surface 78 in axial sliding contact with anti-rotation surface 80. Guide surface 78 could be a flat surface and/or a protruding surface of outer check 54 that mates with surface 80 to prevent outer check 54 from rotating around injector axis 48. It should be appreciated that any of a variety of anti-rotation strategies could be used, including complementary-shaped curved or angular surfaces, flat surfaces, or still another strategy. It will also be appreciated that fuel injector checks are conventionally permitted to rotate during service. According to the present disclosure it is desirable to maintain transfer passages 56 in circumferential alignment with first orifice set 50, hence outer check 54 is prevented from rotating to maintain the desired alignment. Inner check 58 may be permitted to rotate during service, however.

Figure 4:
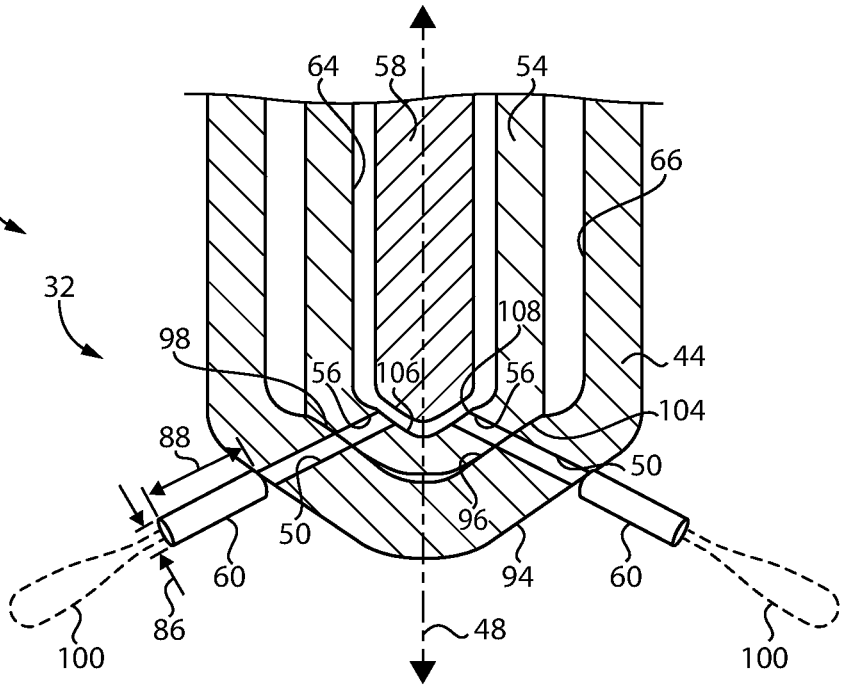
FIG. 4 is a sectioned side diagrammatic view of a portion of a fuel injector, according to one embodiment, and in a first fuel injection state.
Figure 5:
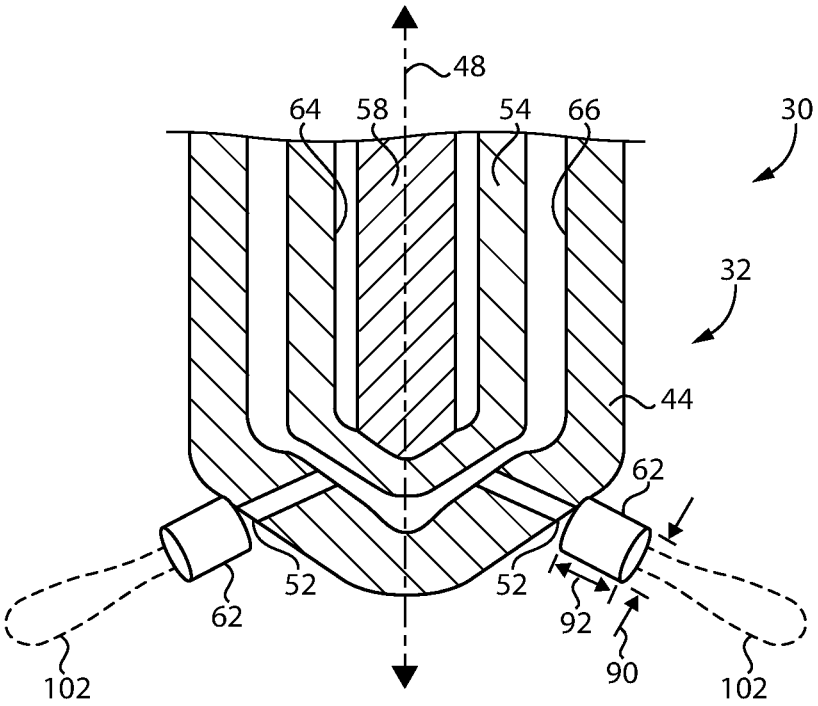
FIG. 5 is a sectioned side diagrammatic view of a portion of a fuel injector, according to one embodiment, in a second fuel injection state.

As noted above, fuel injector 30 is ducted. Fuel injector 30 includes spray ducts coupled to nozzle piece 44 and each arranged for ducting spray jets of fuel from one of the spray orifices of the respective first orifice set 50 and second orifice set 52. In an implementation the spray ducts include a first spray duct set 60 arranged for ducting spray jets of fuel from first orifice set 50, and a second spray duct set 62 arranged for ducting spray jets of fuel from second orifice set 52. Referring also now specifically to FIGS. 4 and 5, at least one of a duct length or a duct inside diameter dimension may differ between first spray duct set 60 and second spray duct set 62. Spray ducts of first spray duct set 60 include a duct inside diameter 86 and a duct length 88. Spray ducts of second spray duct set 62 include a duct inside diameter 90 and a duct length 92. First duct set 60 may be configured such that duct inside diameter 86 is a lesser duct inside diameter, and second duct set 62 configured such that duct inside diameter 90 is a greater duct inside diameter and duct length 92. Duct lengths 88 and 92 may be the same or different in different applications. Ducts 60 and 62 may be round or circular in interior shape although the present disclosure is not limited. Those skilled in the art will envision other arrangements where a first duct set ducting a first orifice set and a second duct set ducting a second orifice set are different in at least one of duct inside diameter or duct length relative to one another.

INDUSTRIAL APPLICABILITY

Referring to the drawings generally, but still focusing on FIGS. 4 and 5, during operating fuel injector 30 inner check 58, nested with outer check 54 in fuel injector 30, can be moved from a closed position to an open position, approximately as shown in FIG. 4, to fluidly connect first fuel passage 64 formed between inner check 58 and outer check 54 to transfer passages 56. With inner check opened, first fuel passage 64 is fluidly connected to spray orifices of first orifice set 50 formed in nozzle piece 44. Fuel may be supplied to first fuel passage 64 from fuel inlet 46, such as by way of an inlet passage 70 that extends through stack 82, and then through outer check 54. With spray orifices of first orifice set 50 now fluidly connected to first fuel passage 64, spray jets 100 of fuel can spray outwardly from fuel injector 30 whilst being ducted by way of first spray duct set 60.

Typically just after, but potentially during, spraying fuel from spray orifices of first orifice set 50 based on the moving of inner check 58 from a closed position to an open position, outer check 54 can be moved from a closed position to an open position to fluidly connect second fuel passage 66 formed between outer check 54 and nozzle piece 44 to both spray orifices of first orifice set 50 and spray orifices of second orifice set 52 formed in nozzle piece 44. Thus, spraying of fuel from first orifice set 50 may be ended prior to commencing spraying of fuel from both orifice set 50 and orifice set 52, although the present disclosure is not thereby limited. Fuel can be supplied to second fuel passage 66 by way of an inlet passage 68 extending through stack 82, as depicted in FIG. 2. With outer check 54 opened, fuel is sprayed from both spray orifices of first orifice set 50 and spray orifices of second orifice set 52, based on the moving of outer check 54 from a closed position to an open position. Spray jets 102 of fuel from second orifice set 52 advance outwardly from fuel injector 30 through second duct set 62, as well as spray jets from first orifice set 50 through first duct set 60. It will thus be appreciated that all of the fuel sprayed from spray orifices of first orifice set 50 and from spray orifices of second orifice set 52 is ducted through spray ducts coupled to nozzle piece 44 in this example. It should also be appreciated that spray ducts described herein as coupled to nozzle piece 44 might be directly attached to nozzle piece 44, such as by a weldment or by a threaded connection, but in some instances could instead be attached to cylinder head 13, such as to cylinder head inside surface 15, and supported in combustion cylinder 14 by a duct holding structure. Ducts 60 and 62 may be positioned so as to be spaced outwardly from nozzle piece 44 such that spray jets traverse a small distance between exiting the respective spray outlets and entering the respective ducts. During operation rotation of outer check 54 about injector axis 48 may be inhibited as discussed herein, and rotation of inner check 58 about injector axis 48 permitted. As discussed in connection with the illustrated embodiment of FIG. 2, inhibiting rotation of outer check 54 may include contacting outer check 54 with fixed anti-rotation surface 80 of injector housing 32, namely, of stack 82, during moving outer check 54 from a closed position to an open position.

From the foregoing description it can be appreciated that fuel injector 30 can be operated to produce separate fuel injections through first orifice set 50 and through both orifice set 50 and orifice set 52. The separate injections could include, respectively, a smaller pilot injection followed by a larger main injection. The two injections could alternatively include, respectively, a main injection, through both orifice sets, followed by a post injection. Either of the pilot then main, or main then post, or potentially pilot, then main, then post, could occur in the same engine cycle. In other instances smaller-quantity injections could be used during lower load operation, through orifice set 50, and larger-quantity injections could be used during higher load operation, through both orifice sets 50 and 52, such as operation at a rated load level. In still other instances, the injection profiles could be overlapped such as to vary the so-called rate shape of a fuel injection in a continuous fuel injection. It should also be appreciated that spray orifices of first orifice set 50 may include lower-flow spray orifices, and spray orifices of second orifice set 52 may be higher-flow spray orifices. The terms "lower-flow" and "higher-flow" are relative terms used herein in relation to each other. Analogously, other uses of the terms "higher" or "greater" and "lesser" or "smaller" are also to be understood herein in a relative sense. Spray orifices of first orifice set 50 may be lesser in flow area, such as a cross-sectional flow area, than spray orifices of second orifice set 52.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A fuel injector comprising:

an injector housing including a nozzle piece defining an injector axis, and having spray orifices formed therein arranged in a first orifice set and a second orifice set;

an outer check within the nozzle piece and movable between a closed position, where each of the first orifice set and the second orifice set are blocked, and an open position, and including transfer passages formed therein;

an inner check within the outer check and movable relative to the outer check between a closed position, where the transfer passages are blocked, and an open position;

spray ducts coupled to the nozzle piece and each arranged for ducting spray jets of fuel from one of the spray orifices; and the outer check is supported at a fixed angular orientation about the injector axis, such that the transfer passages are each in circumferential alignment with one of the spray orifices of the first orifice set.

2. The fuel injector of claim 1 wherein the spray ducts include a first duct set arranged for ducting spray jets of fuel from the first orifice set, and further comprising a second duct set arranged for ducting spray jets of fuel from the second orifice set.

3. The fuel injector of claim 2 wherein at least one of a duct length or a duct inside diameter differs between the first duct set and the second duct set.

4. The fuel injector of claim 2 wherein the spray orifices of the first orifice set are lower-flow spray orifices and the spray orifices of the second orifice set are higher-flow spray orifices.

5. The fuel injector of claim 4 wherein the spray orifices of the first orifice set are lesser in flow area than the spray orifices of the second orifice set.

6. The fuel injector of claim 5 wherein:

a total number of transfer passages formed in the outer check is equal to a total number of spray orifices in the first orifice set; and a circumferential distribution of the transfer passages about the injector axis is matched to a circumferential distribution of the spray orifices in the first orifice set.

7. The fuel injector of claim 1 wherein the outer check includes a guide surface in axial sliding contact with an anti-rotation surface of the injector housing.

8. The fuel injector of claim 1 wherein:

a first fuel passage is formed between the outer check and the inner check and a second fuel passage is formed between the nozzle piece and the outer check; and at the open position of the outer check all of the spray orifices are fluidly connected to the second fuel passage.

9. The fuel injector of claim 8 wherein the outer check includes an outside tip surface and the nozzle piece includes an inside sac surface, and wherein each of the outside tip surface and the inside sac surface is continuous.

10. A method of operating a fuel injector comprising:

moving an inner check nested with an outer check in a fuel injector from a closed position to an open position to fluidly connect a first fuel passage formed between the inner check and the outer check to transfer passages formed in the outer check and fluidly connected to lower-flow spray orifices formed in a nozzle piece of the fuel injector;

spraying fuel from the lower-flow spray orifices based on the moving of the inner check from a closed position to an open position;

moving the outer check from a closed position to an open position to fluidly connect a second fuel passage formed between the outer check and the nozzle piece to both the lower-flow spray orifices and higher-flow spray orifices formed in the nozzle piece;

spraying fuel from both the lower-flow spray orifices and the higher-flow spray orifices based on the moving of the outer check from a closed position to an open position; and ducting all of the fuel sprayed from the lower-flow spray orifices and from the higher-flow spray orifices through spray ducts coupled to the nozzle piece.

11. The method of claim 10 wherein the ducting of all of the fuel includes ducting the fuel sprayed from the lower-flow spray orifices through spray ducts having a lesser duct inside diameter, and ducting the fuel sprayed from the higher-flow spray orifices through spray ducts having a greater duct inside diameter.

12. The method of claim 10 further comprising ending the spraying of fuel from the lower-flow spray orifices, prior to commencing the spraying of fuel from both the lower-flow spray orifices and the higher-flow spray orifices.

13. The method of claim 10 wherein the moving of the inner check includes moving the inner check to fluidly connect a first fuel passage to transfer passages in the outer check having a total number equal to a total number of the lower-flow spray orifices.

14. The method of claim 10 further comprising inhibiting rotation of the outer check about an injector axis, and permitting rotation of the inner check about the injector axis.

15. The method of claim 14 wherein the inhibiting of rotation further includes contacting the outer check with a fixed anti-rotation surface of an injector housing during the moving of the outer check from a closed position to an open position.

16. A fuel injector nozzle assembly comprising:

a nozzle piece defining an injector axis and including an outer nozzle surface, an inner nozzle surface forming a nozzle seat, and having spray orifices formed therein extending from the inner nozzle surface to the outer nozzle surface;

the spray orifices including lower-flow spray orifices forming a first orifice set, and higher-flow spray orifices forming a second orifice set, each orifice set having a circumferential distribution about the injector axis;

spray ducts coupled to the nozzle piece and arranged for ducting spray jets of fuel from the first orifice set and the second orifice set;

an outer check within the nozzle piece and movable between a closed position in contact with the nozzle seat, where the second orifice set is blocked, and an open position, and the outer check including an outer check surface, an inner check surface forming a check seat, and having transfer passages formed therein extending from the inner check surface to the outer check surface; and an inner check within the outer check and movable relative to the outer check between a closed position in contact with the check seat, where the transfer passages are blocked, and an open position.

17. The fuel injector nozzle assembly of claim 16 wherein:

a first fuel passage is formed between the outer check and the inner check and a second fuel passage is formed between the nozzle piece and the outer check; and at the open position of the outer check all of the spray orifices are fluidly connected to the second fuel passage.

18. The fuel injector nozzle assembly of claim 16 wherein:

a total number of transfer passages formed in the outer check is equal to a total number of spray orifices in the first orifice set; and a circumferential distribution of the transfer passages about the injector axis is matched to a circumferential distribution of the spray orifices in the first orifice set.

19. The fuel injector nozzle assembly of claim 18 wherein the spray ducts are arranged in a first duct set ducting the first orifice set and a second duct set ducting the second orifice set and different in at least one of duct inside diameter or duct length relative to the first duct set.

* * * * *